United States Patent [19]

Ross

[11] 4,213,409

[45] Jul. 22, 1980

[54] NEEDLE BAR SUPPORT

[75] Inventor: Roger J. Ross, Mont St-Gregoire, Canada

[73] Assignee: The Singer Company, Stamford, Conn.

[21] Appl. No.: 948,851

[22] Filed: Oct. 5, 1978

[51] Int. Cl.[2] ..... D05B 3/02

[52] U.S. Cl. ..... 112/158 R

[58] Field of Search ..... 112/158 R, 221, 220, 112/157

[56] References Cited

U.S. PATENT DOCUMENTS

| | | | |
|---|---|---|---|
| 2,667,133 | 1/1954 | Court | 112/158 R |
| 2,932,268 | 4/1960 | Johnson | 112/158 R |
| 3,051,107 | 8/1962 | Johnson | 112/158 R |
| 3,084,646 | 4/1963 | Johnson | 112/158 R |
| 3,559,602 | 2/1971 | Illes | 112/158 R |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

The upper one of two spherical bearings supporting the needle bar of a sewing machine for endwise reciprocation is carried in a gate that is pivotally mounted between bifurcated portions of a fixed support located on the rear side of the machine casing. A link is pivotally mounted between bifurcated portions of the gate and operably connected to driving means effective to impart reciprocating movements to the gate resulting in zigzag motion of a needle attached to the lower end of the needle bar.

3 Claims, 4 Drawing Figures

NEEDLE BAR SUPPORT

BACKGROUND OF THE INVENTION

1. Field of the Invention

The invention relates to needle bar zig-zag mechanism for use in a sewing machine.

2. Description of the Prior Art

It has been a common practice in sewing machines to mount a needle bar for endwise reciprocation in an upper and a lower spherical bearing, and for the upper bearing to be carried in a gate which was pivoted on a foot presser bar for actuated movements resulting in zig-zag motion of a needle attached to the lower end of the needle bar. Actuating forces had to be applied to the gate at a point closer to its pivotal axis than was desireable because of the limited amount of space available in the machine. The actuating forces therefor had to be rather large, and a gate of substantial mass which further added to the force requirements had to be utilized to stabilize the operation of the needle bar as required to prevent excessive vibration of the needle.

SUMMARY OF THE INVENTION

In accordance with the invention, the upper one of two spherical bearings, which guide the needle bar of a sewing machine for endwise reciprocation, is located in a gate which is pivoted between bifurcated portions of a fixed support located on the rear side of the machine casing a substantial distance from the needle bar. A link pivotally connected to the gate between bifurcated portions thereof and extending toward the front side of the machine connects with actuating mechanism which is operably associated with a driving motor. The distance between the pivot axis of the gate and the point at which force is applied to the gate is relatively large as compared to prior art arrangements such that only small forces need be applied to a gate of reduced mass to impart zig-zag motion to a needle at the lower end of the needle bar. Excessive vibration of the needle is avoided and loads on the motor driving the actuating mechanism is minimized.

DESCRIPTION OF THE PREFERRED EMBODIMENT OF THE INVENTION

Figure 1:
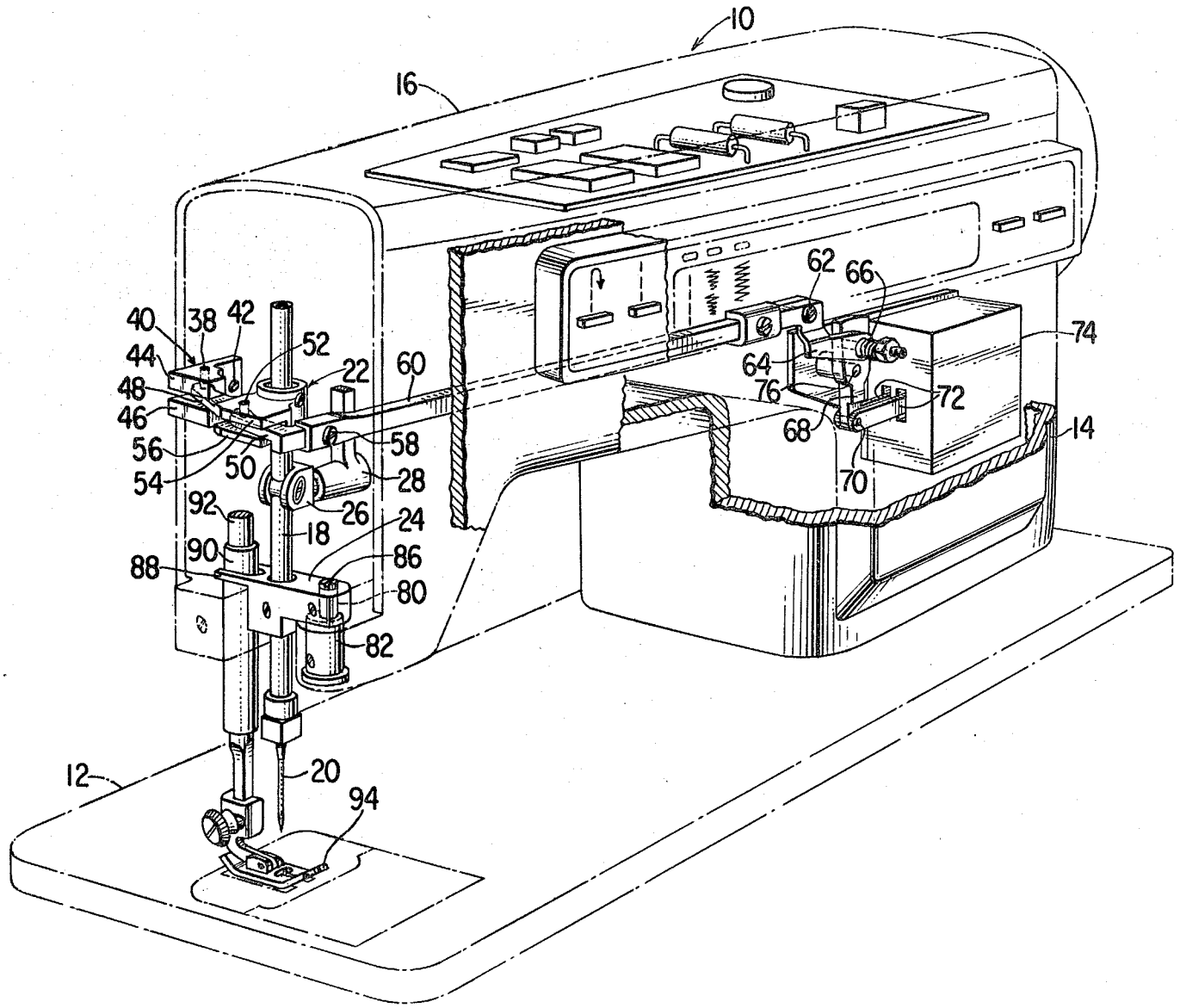
FIG. 1 is a perspective view of a sewing machine including zig-zag mechanism according to the invention and the drive motor therefor.
Figure 2:
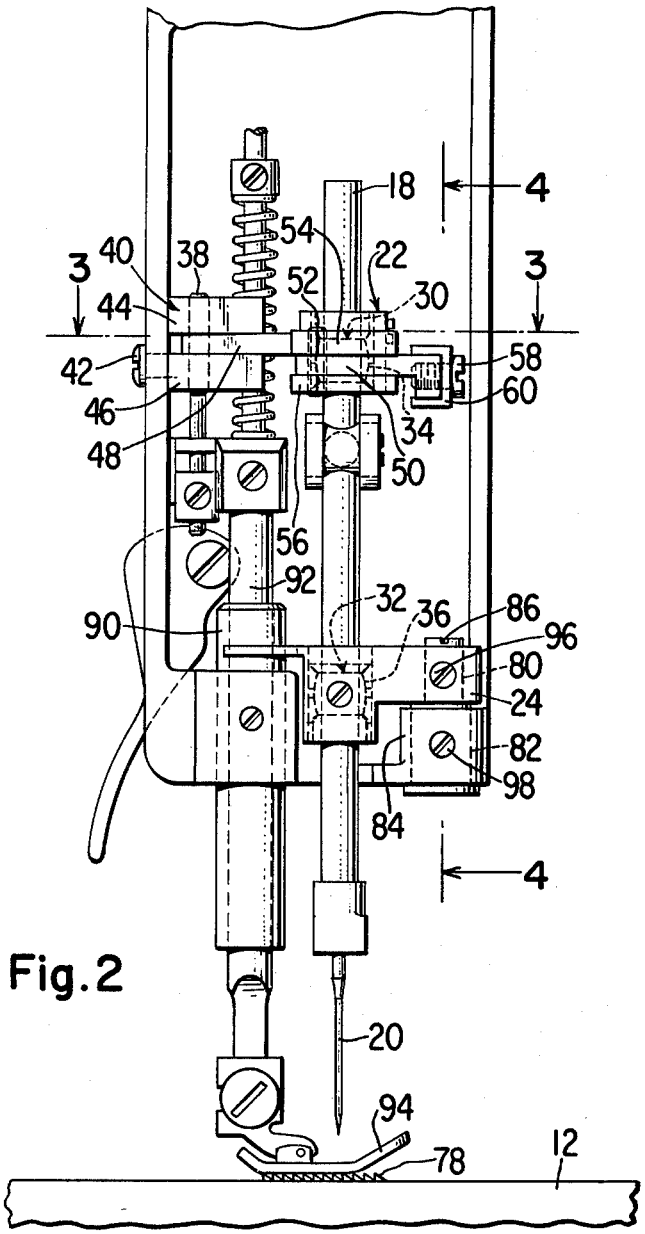
FIG. 2 a front elevation view showing said zig-zag mechanism.
Figure 4:
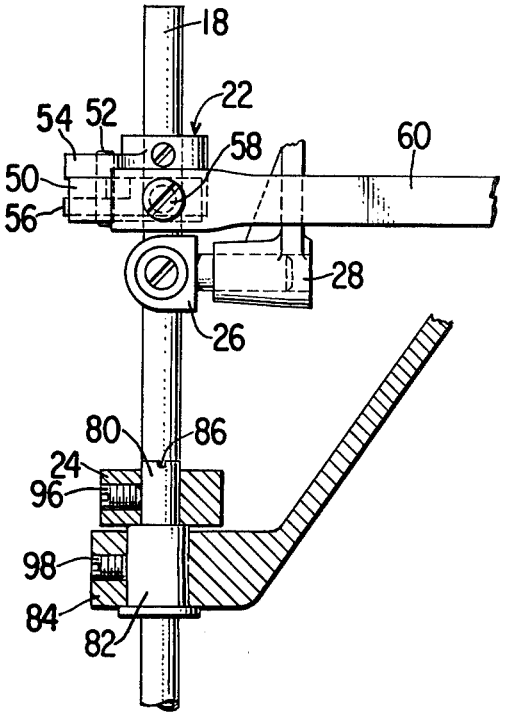
FIG. 4 is a sectional elevational view taken on the plane of the line 4—4 of FIG. 2.
Figure 3:
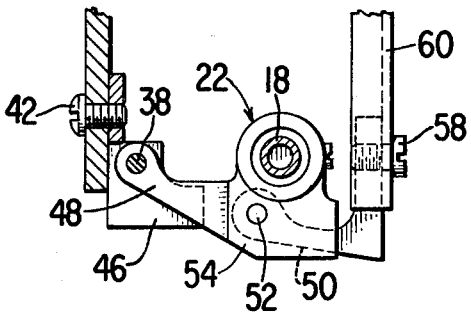
FIG. 3 is a cross-sectional view taken on the plane of the line 3—3 of FIG. 2.

Referring to the drawings, a sewing machine 10 is shown in phantom lines as including a bed 12, a standard 14 rising from the bed and a bracket arm 16 overhanging the bed. A needle bar 18 having a needle 20 affixed to the lower end thereof is supported in bearings within a gate 22 and bracket 24 for endwise reciprocation by an attached collar 26 and a drive link 28 operably connected with the arm shaft (not shown) of the machine. The bearings which support the needle bar 18 for endwise reciprocation are the bearing 30 shown in FIG. 2 within gate 22 and the bearing 32 shown within bracket 24. Such bearings 30 and 32 are formed with outer spherical surfaces 34 and 36 respectively which ride in spherical seats within the parts wherein they are situated.

In accordance with the invention, gate 22 is pivotally mounted at one end on a pin 38 in a fixed support 40. The support is preferably secured, as for example, by screw 42 to the inside rear surface of the casing of the machine and is provided with bifurcated portions 44 and 46 spaced to receive gate arm 48 through which the pin 38 is shown to extend. A link 50 is pivotally connected at one end to the gate 22 by a pin 52 extending through the link and bifurcated gate portions 54 and 56 embracing the link. The other end of link 50 is affixed by a screw 58 to one end of an actuating arm 60. The other end of the actuating arm is affixed by a screw 62 to a link 64 which is pivotally connected at 66 to one end of a link 68 having its opposite end pivoted at 70 to the output arms 72 of a linear bight motor 74. Link 68 is pivotally connected at an intermediate location to a fixed pin 76.

The linear bight motor 74 which may be any type of motorized linear actuator and of which the linear actuator shown and described in U.S. Pat. No. 3,984,755 is one example is to be understood as responsive to pattern control signals as described in the said patent. Such motor acts as indicated in said patent, in timed relation to reciprocating movements of needle 20, and through the link 68, link 64, actuating arm 60, and link 20 to impart pivotal reciprocating movements to gate 22 resulting in zig-zag movements of the needle 20. The machine is to be understood as also including means such as described for example in U.S. Pat. No. 3,984,755 for controlling work feeding movements of a feed dog 78 in timed relation to the zig-zagging and reciprocating movements of needle 20.

As shown, one end of the bracket 24 is pivoted on a stud 80 that is eccentrically located on a rotatably adjustable shaft 82. The shaft 82 is turnable in a fixed boss 84 and can be adjusted with a screw driver which has been inserted in slot 86. As the shaft 82 is turned, bracket 24 is moved rearwardly, that is to the left as viewed in FIG. 2, and in this manner the bracket may be caused, at the time the machine is assembled, to position the needle 20 on the arc of a vertical axis hook (not shown) as required for proper sewing. Bracket 24 includes a forked end 88 which embraces the fixed bushing 90 of a shaft 92 having a presser foot 94 attached to its lower end. Such forked end 88 serves to guide movements of the bracket 24 caused by turning shaft 82. When needle 20 has been suitably positioned, stud 80 and shaft 82 can be locked to boss 84 with set screws 96 and 98.

As indicated, the actuator acts through connecting members to impart pivotal reciprocating movements to gate 22, the gate being caused to swing back and forth about pin 38. The spherical bearings 30 and 32 which support the needle bar 18 pivot in the gate 22 and bracket 24 respectively, and the needle 20 is caused to move in zig-zag fashion along an arcuate path. Vibration of the gate and associated actuating mechanism is virtually non-existent because of the manner in which the gate is pivotally supported, that is between bifurcated portions 44 and 46 of support 40, and in which link 50 is supported for pivotal motion on the gate, that is between bifurcated gate portions 54 and 56. The use of a gate of large mass such as has been employed in prior art constructions to provide stable gate connections effective to limit vibration is avoided, and dynamic loads on the motor are substantially reduced as a consequence. Dynamic loading of the gate is further reduced with the construction of the invention because the distance between the pivotal axis of the gate and pin 52 where force is applied to the gate is relatively large as compared to prior art arrangements such that only small forces need be applied to the gate to impart zig-zag motion to a needle at the lower end of the needle bar.

Various alterations of the structure herein disclosed will suggest themselves to those skilled in the art. However, it is to be understood that the present disclosure relates to a preferred embodiment of the invention which is for purposes of illustration only and is not to be construed as a limitation of the invention. All such modifications which do not depart from the spirit and scope of the invention are intended to be included within the scope of the claims.

I claim:

1. In a sewing machine, the combination comprising a needle bar, a needle affixed to the lower end of the needle bar, upper and lower bearings each of which has an outer spherical surface and in which the needle bar is supported for endwise reciprocation, a fixed support including bifurcated portions on the frame of the machine, a gate having one end pivotally mounted between the bifurcated portions of the fixed support and including a spherical seat which supports the upper bearing, a bracket supported at opposite ends in the machine and including a spherical seat which supports the lower bearing, a link pivotally mounted on the gate, and driving means operably connected to the link and effective through said link to impart pivotal reciprocating movements to the gate resulting in zig-zag motion of the lower end of the needle bar and needle affixed thereto.

2. The combination of claim 1 wherein the gate includes bifurcated portions and said link is pivotally connected to the gate between the bifurcated portions thereof.

3. In a sewing machine, the combination comprising a needle bar, a needle affixed to the lower end of the needle bar, upper and lower bearings each of which has an outer spherical surface and in which the needle bar is supported for endwise reciprocation, a fixed support on the frame of the machine, a gate having one end pivotally mounted in the fixed support and including a spherical seat which supports the upper bearing, a bracket supported at opposite ends in the machine and including a spherical seat which supports the lower bearing, a link pivotally mounted on the gate, driving means operably connected to the link and effective through said link to impart pivotal reciprocating movements to the gate resulting in zig-zag motion of the lower end of the needle bar and needle affixed thereto, adjustable means at one end of the bracket for preselecting the position in the machine of the bracket to thereby position the needle affixed to the lower end of the needle bar, and a fixed member at the other end of the bracket, such other end of the bracket including forked portions which embrace the fixed member.

* * * * *